US005680092A

United States Patent [19]

Yamada et al.

[11] Patent Number: 5,680,092

[45] Date of Patent: Oct. 21, 1997

[54] CHIP RESISTOR AND METHOD FOR PRODUCING THE SAME

[75] Inventors: Hiroyuki Yamada, Fukui; Akio Fukuoka, Sabae; Seiji Tsuda, Fukui, all of Japan

[73] Assignee: Matsushita Electric Industrial Co., Ltd., Kadoma, Japan

[21] Appl. No.: 337,935

[22] Filed: Nov. 10, 1994

[30] Foreign Application Priority Data

Nov. 11, 1993 [JP] Japan ..... 5-282407
Sep. 14, 1994 [JP] Japan ..... 6-220109

[51] Int. Cl.[6] ..... H01C 1/012

[52] U.S. Cl. ..... 338/309; 338/308; 338/332

[58] Field of Search ..... 338/332, 306, 338/308, 309; 29/610.1, 620, 621

[56] References Cited

U.S. PATENT DOCUMENTS

| | | | |
|---|---|---|---|
| 2,662,957 | 12/1953 | Eisler | 338/308 |
| 3,857,683 | 12/1974 | Castonguay | 29/195 P |
| 3,958,071 | 5/1976 | Hieber et al. | 428/411 |
| 4,087,778 | 5/1978 | Merz et al. | 338/309 |
| 4,140,817 | 2/1979 | Brown | 427/96 |
| 4,264,646 | 4/1981 | Thornburg et al. | 427/98 |
| 4,301,439 | 11/1981 | Johnson et al. | 338/195 |
| 4,454,495 | 6/1984 | Werner et al. | 338/195 |
| 4,517,546 | 5/1985 | Kakuhashi et al. | 338/320 |
| 4,576,659 | 3/1986 | Lewis et al. | 148/127 |
| 4,677,413 | 6/1987 | Zandman et al. | 338/307 |
| 4,774,491 | 9/1988 | Vugts | 338/306 |
| 4,780,702 | 10/1988 | Snel et al. | 338/308 |
| 4,792,781 | 12/1988 | Takahashi et al. | 338/307 |
| 5,243,320 | 9/1993 | Clouser et al. | 338/308 |

OTHER PUBLICATIONS

Dummer, "Materials For Conductive And Resistive Functions", Table2.2, (1970).

*Primary Examiner*—Philip H. Leung
*Assistant Examiner*—Karl Easthom
*Attorney, Agent, or Firm*—Renner, Otto, Boisselle & Sklar, P.L.L.

[57] ABSTRACT

A high precision chip resistor having a low resistance and a small TCR is obtained. This chip resistor includes an insulating substrate, a resistive layer made of a Cu—Ni alloy formed at least on one face of the insulating substrate, and end face electrodes provided on a pair of end faces of the insulating substrate facing each other so as to be connected to the resistive layer. The resistive layer is formed by heat-treating a plating layer containing Cu and Ni at high temperature. The end face electrodes are formed by metal thin film deposition technique at low temperature. A method for producing the chip resistor is also provided.

26 Claims, 5 Drawing Sheets

CHIP RESISTOR AND METHOD FOR PRODUCING THE SAME

BACKGROUND OF THE INVENTION

1. Field of the Invention

The present invention relates to a chip resistor widely used for an electronic circuit, particularly to a high precision chip resistor having a small temperature coefficient of resistance in a low range of resistance.

2. Description of the Related Art

With the miniaturization of electronic equipment, there has been increased demand for surface-mount components so as to reduce the area for mounting electronic components. Under this circumstance, high precision chip resistors have been demanded as alternatives to conventionally used trimming volumes. In particular, the demand for chip resistors having a low resistance and a small temperature coefficient of resistance used in a power supply circuit has been increased.

An example of a method for producing a conventional chip resistor will be described with reference to the drawing. FIG. 6 is a cross-sectional view showing an exemplary configuration of a conventional square chip resistor. First, top face electrodes 22 and bottom face electrodes 23 are respectively formed on a top face and a bottom face of a chip-shaped alumina substrate 21 made of 96% alumina. Then, a resistive element 24 is formed on a part of the top face of the alumina substrate 21 so as to be connected to the top face electrodes 22. A protective film 25 made of lead borosilicate glass is formed so as to completely cover the resistive element 24. In general, the protective film 25 is patterned by screen printing, followed by baking at a high temperature in the range of 600° C. to 850° C. Thereafter, end face electrodes 26 made of a silver-type thick film are formed on end faces of the alumina substrate 21 so as to connect the top face electrodes 22 and the bottom face electrodes 23. In general, the end face electrodes 26 are formed by baking at a high temperature of about 600° C. Finally, in order to ensure reliability for conducting soldering, Ni-plating films 27 are formed so as to cover the end face electrodes 26 by electroplating and solder plating films 28 are formed so as to cover the Ni-plating films 27.

In the conventional chip resistor produced as described above, a thick film glaze resistive material mainly containing ruthenium oxide is generally used as conductive particles for the resistor. In the resistive material essentially consisting of ruthenium oxide, a temperature coefficient of resistance (hereinafter, referred to as TCR), which indicates the change in resistance depending upon temperature, can be controlled at a lower value within about ±50 ppm/° C. by adding a TCR adjusting agent such as a metal oxide. However, in the case of using such a resistive material, a chip resistor having a low resistance of 1 Ω or less cannot be produced because of the high resistivity of ruthenium oxide. Thus, for the purpose of obtaining a chip resistor having a low resistance, the resistance is controlled in a range of 1 Ω or less by adding metal powders such as Ag powder and Pd powder to ruthenium oxide. Metals such as Ag and Pd have a TCR as high as +600 to +1000 ppm/° C. Thus, in the case of the resistive element prepared so as to have a resistance in a range of 1 Ω or less by adding Ag or Pd, the TCR of the resistive element becomes +600 to +1000 ppm/° C. which is the TCR of the metal powders themselves (i.e., Ag or Pd), because of a high content of Ag or Pd in the resistive material. Therefore, in this case, the TCR cannot be controlled by adding the TCR adjusting agent.

As described above, according to the conventional production method, although a chip resistor having a low resistance can be obtained, a high precision resistor having a small TCR as well as a low resistance cannot be obtained.

SUMMARY OF THE INVENTION

The chip resistor of this invention, includes an insulating substrate, a resistive layer made of a Cu—Ni alloy formed on at least one face of the insulating substrate, and end face electrodes provided on a pair of end faces of the insulating substrate facing each other so as to be connected to the resistive layer.

In one embodiment of the invention, the resistive layer is made of a Cu—Ni alloy formed by heat-treating a plating layer containing Cu and Ni.

In another embodiment of the invention, the resistive layer is made of a Cu—Ni alloy whose weight ratio of Cu to Ni is in the range of 55:45 to 65:35.

In another embodiment of the invention, the resistive layer is made of a Cu—Ni alloy whose weight ratio of Cu to Ni is 60:40.

In another embodiment of the invention, the end face electrodes are made of a metal thin film formed from metal selected from the group consisting of Cr, a Cr alloy, Ti, and Ni at low temperature by a thin film deposition technique.

In another embodiment of the invention, the end face electrodes are made of a metal thin film formed from an Ni—Cr alloy.

In another embodiment of the invention, the end face electrodes are provided so as to cover the pair of end faces of the insulating substrate facing each other in substantially a ]-shape.

In another embodiment of the invention, the above-mentioned chip resistor further includes a protective layer provided at least on a portion of the resistive layer which is not covered with the end face electrodes.

According to another aspect of the invention, a method for producing a chip resistor, includes the steps of: forming a plating underlying layer at least on one face of an insulating substrate; forming a plating layer containing Cu and Ni on the plating underlying layer; heat-treating the plating layer containing Cu and Ni to form a resistive layer; and depositing metal thin films on a pair of end faces of the insulating substrate facing each other so as to be connected to the resistive layer.

In one embodiment of the invention, the plating layer containing Cu and Ni is formed by alternately repeating Cu-plating and Ni-plating a plurality of times.

In another embodiment of the invention, the plating layer containing Cu and Ni is formed by the step of forming a first plating layer selected from the group consisting of a Cu-plating layer and an Ni-plating layer, and the step of forming a second plating layer containing a Cu—Ni alloy on the first plating layer.

In another embodiment of the invention, the plating layer containing Cu and Ni is formed so that the resistive layer is made of a Cu—Ni alloy whose weight ratio of Cu to Ni is in the range of 55:45 to 65:35.

In another embodiment of the invention, the plating layer containing Cu and Ni is formed so that the resistive layer is made of a Cu—Ni alloy whose weight ratio of Cu to Ni is 60:40.

In another embodiment of the invention, the end face electrodes are made of metal selected from the group consisting of Cr, a Cr alloy, Ti, and Ni.

In another embodiment of the invention, the end face electrodes are made of a metal thin film formed from an Ni—Cr alloy.

In another embodiment of the invention, the metal thin film is deposited by sputtering, ion plating, or plasma CVD.

In another embodiment of the invention, the end face electrodes are formed so as to cover the pair of end faces of the insulating substrate facing each other in substantially a ]-shape.

In another embodiment of the invention, the above-mentioned method further includes the step of forming a protective layer on the resistive layer.

Thus, the invention described herein makes possible the advantages of (1) providing a chip resistor having a low resistance and a small TCR; (2) providing a chip resistor having less drift of the resistance and less change in the TCR; (3) providing a method for producing a chip resistor having a low resistance and a small TCR; (4) providing a method for controlling a TCR of a chip resistor by changing the ratio of Cu to Ni in a resistive layer; and (5) providing a method for preventing the drift of the resistance and a change in TCR of the chip resistor by forming end face electrodes made of a metal thin film without performing a high temperature baking step.

These and other advantages of the present invention will become apparent to those skilled in the art upon reading and understanding the following detailed description with reference to the accompanying figures.

DESCRIPTION OF THE PREFERRED EMBODIMENTS

Hereinafter, the chip resistor according to the present invention will be described with reference to the drawings.

EXAMPLE 1

Figure 1:
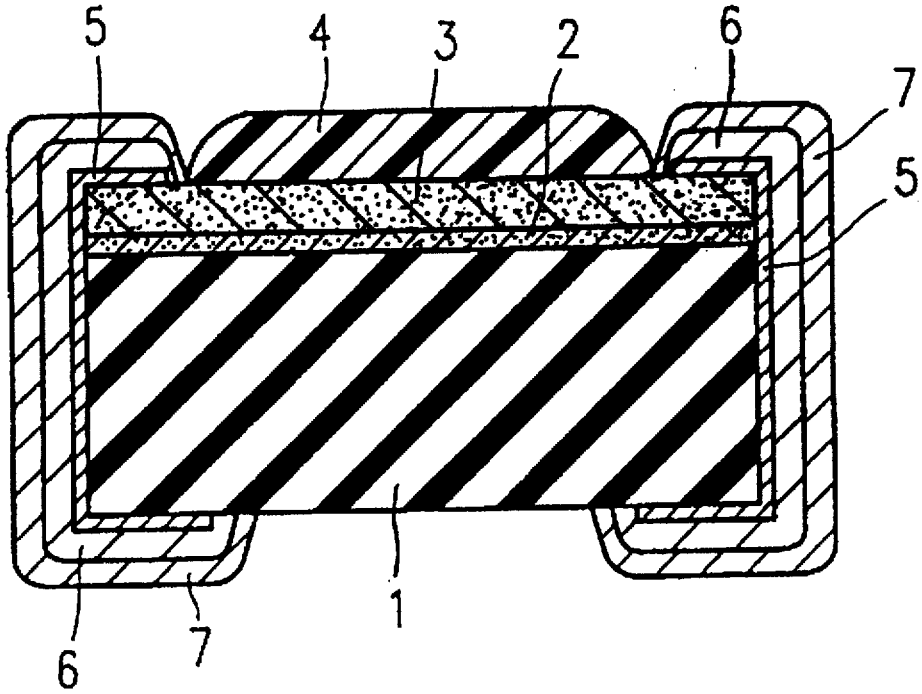
FIG. 1 is a cross-sectional view showing a configuration of a square chip resistor of Examples 1 and 2 according to the present invention.

FIG. 1 shows one embodiment of a chip resistor according to the present invention. In this chip resistor, a plating underlying layer 2 is formed on one surface of a square substrate 1 by a thick film technique such as screen printing. Then, a resistive layer 3 made of a Cu—Ni alloy is formed on the plating underlying layer 2, and a protective layer 4 is formed so as to cover a part of the resistive layer 3. End face electrodes 5 are provided by thin film deposition technique such as sputtering, ion plating, and plasma CVD so as to cover a pair of end faces of the substrate 1 facing each other in substantially a ]-shape and connected to portions of the resistive layer 3 which are not covered with the protective layer 4, as shown in FIG. 1. Furthermore, Ni-plating films 6 are formed so as to cover the end face electrodes 5, and solder plating films 7 are formed on the Ni-plating films 6.

Hereinafter, a method for producing the chip resistor will be described with reference to FIG. 2.

First, the substrate 1 made of alumina is provided The plating underlying layer 2 is formed on one surface of the substrate 1. The plating underlying layer 2 is formed by printing a paste for plating activation containing Pd on the substrate 1 by screen printing, followed by baking at a peak temperature of 400° C. in a belt-type continuous baking oven. This peak temperature is retained for 5 minutes. The plating underlying layer 2 thus formed is a thin metal coating with a thickness of 1 μm or less, the coating penetrating the unevenness of the surface of the substrate 1. The plating underlying layer 2 functions as a core for growth of plating in the subsequent electroless plating step and increases the adhesion between the resistive layer 3 and the substrate 1.

Next, an Ni-plating layer is formed on the plating underlying layer 2 containing Pd by electroless plating. On the electroless Ni-plating layer thus formed, a Cu-plating layer (copper cyanide plating) and an Ni-plating layer are alternately formed a plurality of times by electroplating to form a Cu—Ni multi-layered plating. It is noted that, in this electroplating, the Ni-plating is always conducted after the Cu-plating, and the Ni-plating layer is formed as the outermost layer. In the above-mentioned electroless plating process, a Cu-plating layer can be formed instead of forming the Ni-plating layer. In this case, the Ni-electroplating is first conducted in the subsequent electroplating process, and the Cu-electroplating and Ni-electroplating are alternately repeated a plurality of times as described above. In either case, the Ni-plating layer is formed as the outermost layer. It is appreciated that any kinds of known Cu-platings can be used as the Cu-electroplating, instead of copper cyanide plating. Furthermore, instead of forming the Cu-plating layer and the Ni-plating layer by electroplating in the above-mentioned process, the Cu-plating layer and the Ni-plating layer can be formed by electroless plating in the same manner as the above. It should be noted that since the growth of a plating layer is slow in the case of electroless plating, electroplating is preferred in terms of high productivity.

Figure 4A:
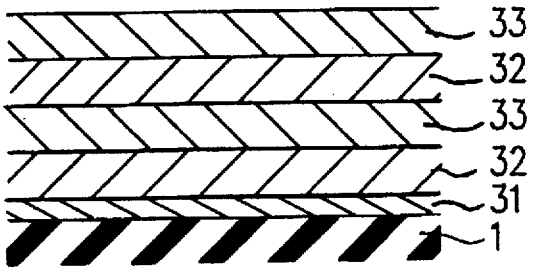
FIGS. 4A and 4B schematically show a process for forming a Cu—Ni alloy resistive layer from a Cu-plating layer and an Ni-plating layer in the production of the square chip resistor of Example 1 according to the present invention.
Figure 4B:
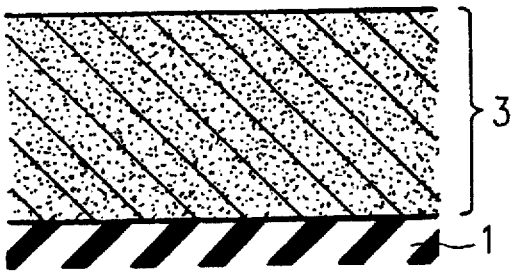

Next, the Cu—Ni multi-layered plating is subjected to heat treatment so as to form a Cu—Ni alloy, thereby obtaining the resistive layer 3 made of a Cu—Ni alloy. This heat treatment is conducted by placing the substrate 1 with the Cu—Ni multi-layered plating formed thereon for 2 hours in a heat treatment oven at 800° C. At this time, in order to prevent the resistive layer 3 from oxidizing, a green gas (i.e., nitrogen gas containing 10% hydrogen) is supplied to the oven. During the high-temperature heat treatment, the Cu—Ni alloy resistive layer 3 is formed from the Cu-plating layer end the Ni-plating layer. FIGS. 4A and 4B schematically show the process for forming the Cu—Ni alloy resistive layer 3 from the Cu-plating layer and the Ni-plating layer. FIG. 4A shows a Cu—Ni multi-layered plating on the substrate 1 before heat treatment. FIG. 4B shows a Cu—Ni alloy resistive layer 3 on the substrate 1 after heat treatment. An Ni-electroless plating layer 31, Cu-plating layers 32, and Ni-plating layers 33 form an alloy by heat treatment so as to provide a Cu—Ni alloy layer 3. Thereafter, the resistance of the resistive layer 3 is corrected to the desired resistance by laser trimming.

Figure 3:
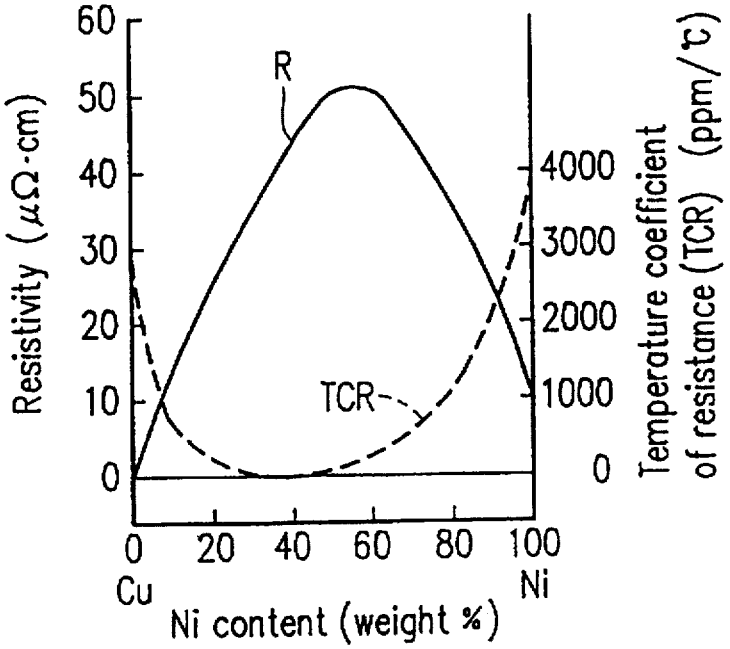
FIG. 3 is a graph showing the relationships among the Ni content, the resistivity, and the TCR of a Cu—Ni alloy resistive element.

There is a correlation between the metal composition, the resistivity, and the TCR of the Cu—Ni alloy. Thus, as shown in FIG. 3, the TCR can be controlled by varying the ratio of Cu to Ni in the Cu—Ni alloy. As shown in FIG. 3, when the ratio of Cu to Ni is 60:40 (weight ratio), the TCR becomes minimum. The ratio of Cu to Ni in the Cu—Ni alloy resistive layer 3 preferable for obtaining a chip resistor with a small TCR and high precision is in the range of 55:45 to 65:35. In the present example, the ratio of Cu to Ni in the alloy is set to be 60:40. In order to obtain such an alloy, during the step of forming the multi-layered plating made of the Cu-plating layer and the Ni-plating layer, plating conditions such as the plating time, the plating current, and the number of plating steps are determined so that the ratio of Cu to Ni is nearly 60:40. It is understood from FIG. 3, the resistivity of the Cu—Ni alloy is also varied depending upon the ratio of Cu to Ni. However, since the resistance can be controlled by varying the thickness of the resistive layer 3, i.e., the resistance is decreased as the thickness is increased, a resistive layer with a low resistance and a small TCR can be obtained. Furthermore, as described above, the resistance can be adjusted by laser trimming and the like.

In the above-mentioned step, the Cu—Ni alloy resistive layer 3 having a desired resistance and TCR can be formed. It should be noted that a high-temperature step influencing the resistance characteristic should not be conducted in the subsequent steps. Thus, the subsequent steps are conducted in a low-temperature process as shown below.

Figure 2:
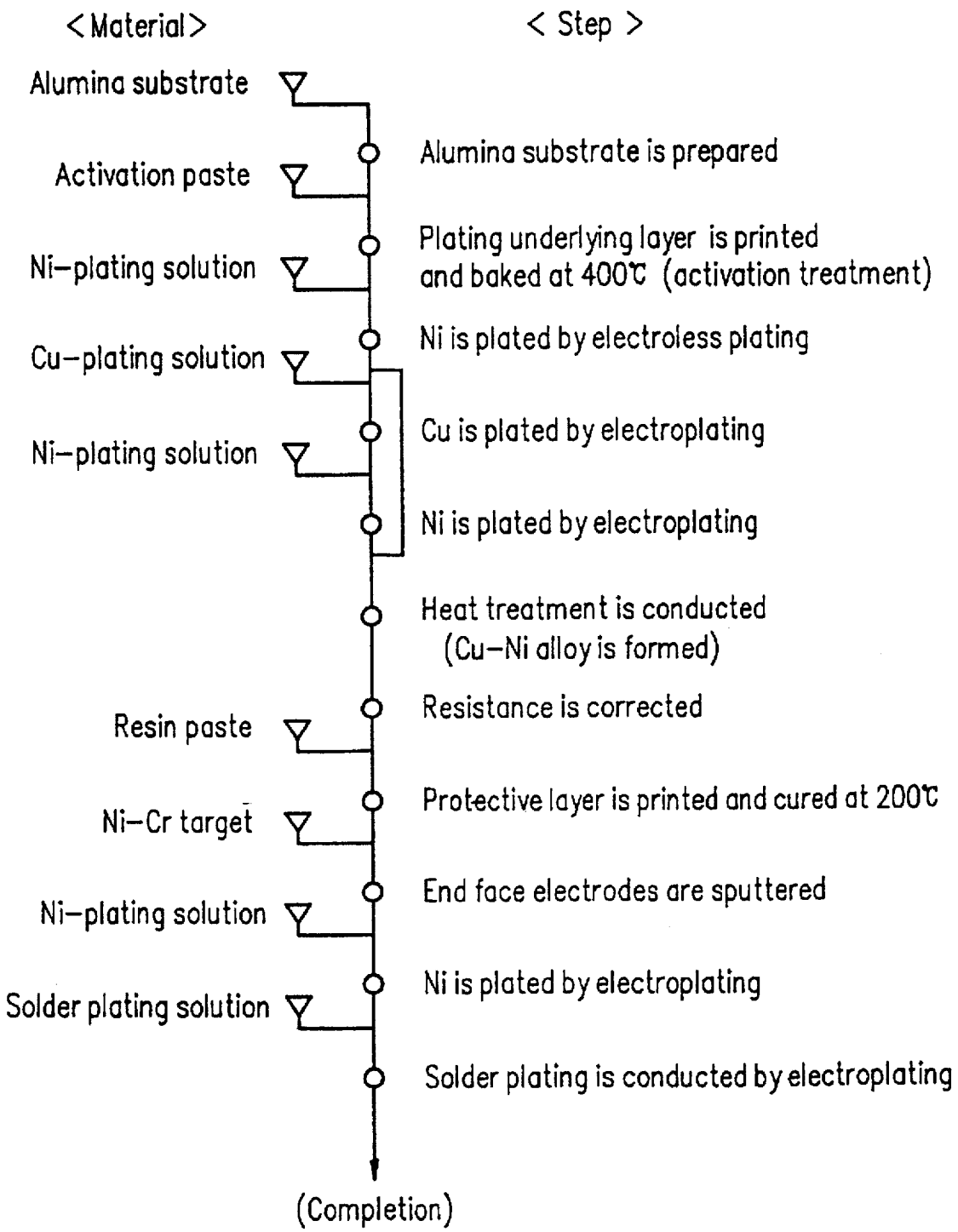
FIG. 2 is a flow chart showing a method for producing a square chip resistor of Example 1 according to the present invention.

As shown in FIG. 2, an epoxy resin paste, which is excellent in moisture resistance and heat resistance, is screen-printed on a part of the resistive layer 3 after its resistance is corrected, and the substrate 1 with the resistive layer 3 and the epoxy resin paste thus formed is dried in a BOX drier at 200° C. for 30 minutes to cure the epoxy resin, thereby forming the protective layer 4. Then, the end face electrodes 5 are formed so as to cover a pair of end faces of the substrate 1 facing each other in a ]-shape and connected to exposed portions of the resistive layer 3 which are not covered with the protective layer 4. The end face electrodes 5 are formed by heating the substrate 1 at 200° C. for 10 minutes and then by depositing a metal thin film by sputtering, using an Ni—Cr target (Ni:Cr=1:1) which has good adhesion with the Cu—Ni alloy resistive layer 3. The end face electrodes 5 can be made of metals such as Cr, Cr alloys other than an Ni—Cr alloy, Ti and Ni. The end face electrodes 5 can be formed by any method requiring no heat treatment at high temperature instead of sputtering. In particular, the end face electrodes 5 are preferably made of a metal thin film, and the metal thin film can be formed by a thin film deposition technique requiring no heat treatment at high temperature (i.e., about 300° C. or more) such as ion plating and plasma CVD in addition to sputtering. In the present specification, such thin film deposition techniques are also referred to as a low-temperature thin film deposition technique.

Finally, in order to ensure reliability during soldering of the electrode portions, the Ni-plating films 6 are formed so as to cover the end face electrodes 5 by electroplating and the solder plating films 7 are formed so as to cover the Ni-plating films 6 by electroplating, thus producing a square chip resistor according to the present invention.

The chip resistor produced by the above-mentioned method has high precision, while maintaining a low resistance in the range of about 20 mΩ to about 200 mΩ and a low TCR (i.e., about +30 ppm/° C. ).

EXAMPLE 2

Figure 5:
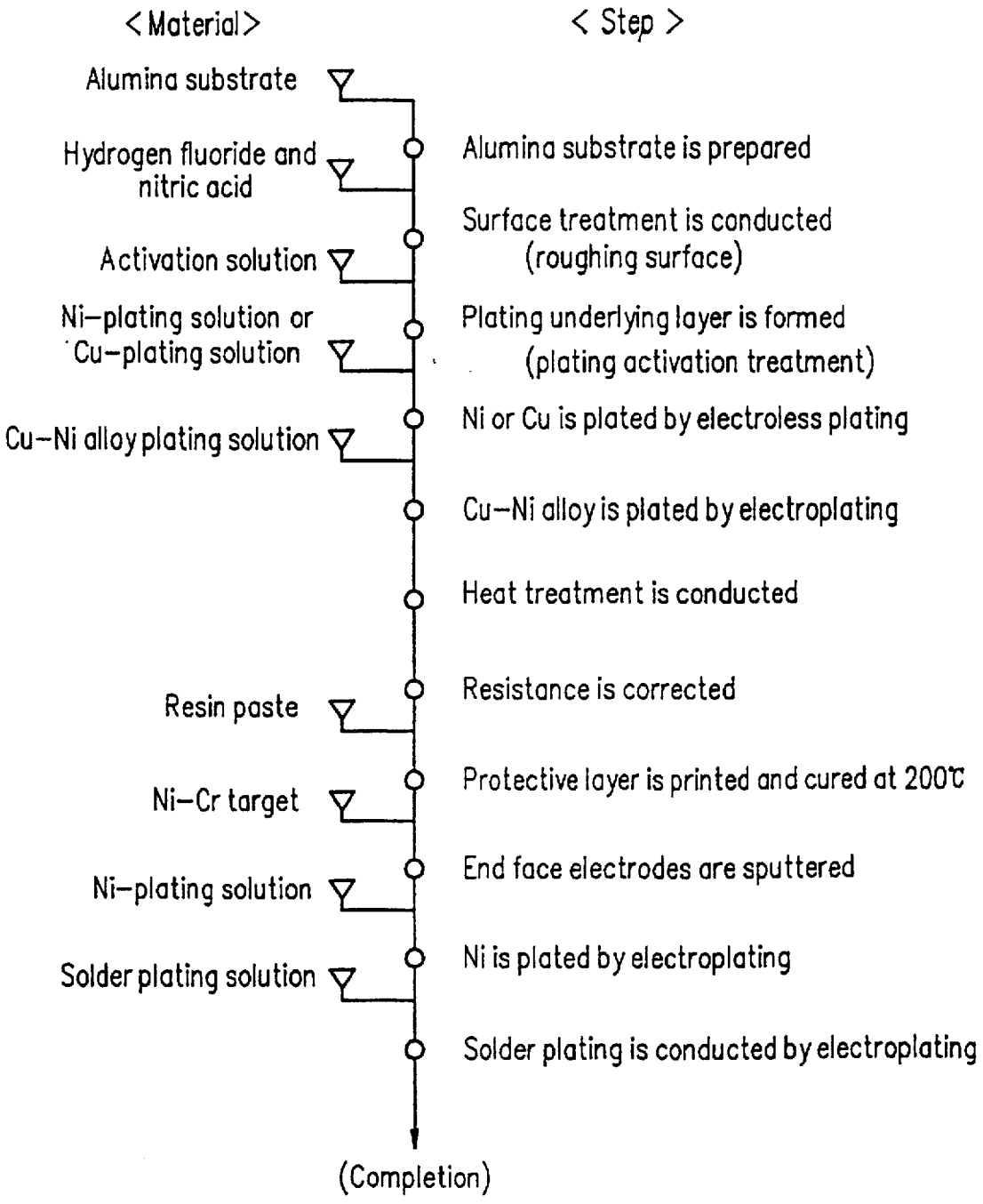
FIG. 5 is a flow chart showing a method for producing the square chip resistor of Example 2 according to the present invention.
Figure 6:
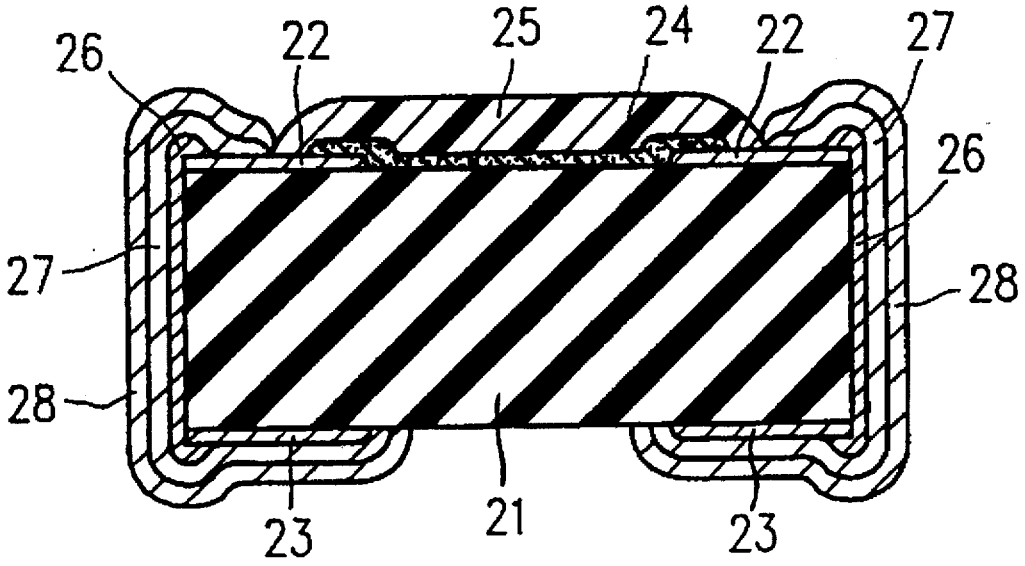
FIG.6 PRIOR ART
FIG. 6 is a cross-sectional view showing a configuration of a conventional square chip resistor.

Hereinafter, Example 2 according to the present invention will be described. The present example is different from Example 1 in the method for forming the plating underlying layer 2 and the Cu—Ni alloy resistive layer 3. A specific method for producing a square chip resistor of the present example will be described with reference to FIG. 5.

The substrate 1 made of alumina is subjected to a surface treatment to uniformly make the surface thereof rough. By this surface treatment, the Cu—Ni alloy resistive layer 3 to be formed later firmly adhered to the substrate 1 via the plating underlying layer 2 (i.e., an anchor effect is obtained). The surface treatment is conducted by soaking the substrate 1 in a mixed solution of hydrogen fluoride and nitric acid. In order to form the plating underlying layer 2 only on portions of the substrate 1 above which the resistive layer 3 is to be formed, an anti-plating resist paste is printed on the other portions of the substrate 1 by screen printing and is cured. Then, the substrate 1 with this resist is soaked in a plating activation solution containing Pd, whereby the plating underlying layer 2 is formed. Pd penetrates the unevenness of the surface of the substrate 1 to work as a core for the growth of plating in the subsequent electroless plating.

Then, an Ni-plating layer or a Cu-plating layer is formed on the plating underlying layer 2 by electroless plating. Thereafter, a Cu—Ni alloy plating layer is formed by electroplating on the electroless plating layer. In the present example, a Cu—Ni alloy is plated using a pyrophosphoric acid bath, and the ratio of Cu to Ni in the bath is adjusted so that the ratio of Cu to Ni in the Cu—Ni alloy plating layer becomes almost 60:40. In order to obtain a desired resistance, the plating conditions such as the plating time and plating current are determined to adjust the thickness of the plating layer. Then in order to alloy the Cu—Ni alloy plating layer completely and to stabilize the resistance characteristic (in particular, TCR), the substrate 1 with the Cu—Ni alloy plating layer 3 formed thereon is placed for one hour in a heat treatment oven at 800° C. Simultaneously, for the purpose of preventing the oxidation of the resistive layer 3, green gas (i.e., nitrogen gas containing 10% hydrogen) is supplied into the oven.

Thereafter, in the same way as in Example 1, the respective steps such as the correction of a resistance, the printing and curing of a protective layer, the sputtering of the end face electrodes, the formation of an Ni-plating film by electroplating, and the formation of a solder plating film by electroplating are conducted, whereby the square chip resistor of the present example is produced. The chip resistor thus produced is a high precision product having a low resistance in the range of about 20 mΩ to about 200 mΩ and a low TCR (i.e., about +30 ppm/° C. ).

In Example 2, the Cu—Ni alloy plating layer is used as a plating layer containing Cu and Ni. Because of this, defects of plating layers such as swelling, and peeling-off are not likely to occur, compared with Example 1 in which the Cu-plating layer and the Ni-plating layer are alternately formed a plurality of times to obtain the Cu—Ni multi-layered plating. In addition, the adhesion between the resistive layer 3 and the substrate 1 becomes more satisfactory in Example 2. The reason for this is that the inner stress between the plating layers, in particular, the stress inside of the Ni-plating layer is present in Example 1.

In Examples 1 and 2, the process for producing an individual chip resistor is described. In general, in order to improve the productivity, a plurality of chips are simultaneously produced by using a sheet-shaped alumina substrate with a plurality of dividing slits in the vertical and horizontal directions thereof. In this case, as a step prior to forming the end face electrodes, a primary diving step for exposing the end faces of the substrate is added, and after forming the end face electrodes, a secondary diving step for obtaining individual chip resistors is added.

In the above-mentioned examples, the alumina substrate is used. Alternatively, substrates made of known insulating materials other than alumina, such as aluminum nitride can be used.

Although, in Examples 1 and 2, the methods for forming the resistant layer 3 and those for forming the plating underlying layer 2 are different, the method for forming the plating underlying layer 2 in Example 1 (i.e., a method using an activation paste) can be applied to the method for forming the resistive layer 3 in Example 2. Alternatively, the method for forming the plating underlying layer 2 in Example 2 (i.e., a method using an activation solution) can be applied to the method for forming the resistive layer 3 in Example 1. Alternatively, any known methods for forming an underlying layer applicable to electroless plating, that is, a method of surface treatment of a substrate can be used, in addition to the method for forming the plating underlying layer described in the above-mentioned examples. As a core for the growth of an electroless plating, Ag, Au, etc. can be used in addition to Pd. In the above-mentioned examples, electrodes are not formed on the surface of the substrate where the resistive layer is formed. Alternatively, such electrodes can be formed. For example, a metal organic (MO) gold paste is printed on the substrate by screen printing and baked at a temperature of about 850° C. to form a very thin gold-type metal coating which works as an electrode. Thereafter, the plating underlying layer is formed by using the activation paste in accordance with Example 1, and the subsequent steps are conducted in accordance with Example 1 or 2, thereby forming a chip resistor. By forming the electrode on the surface of the substrate where the resistive layer is formed, the precision of the resistance can be further enhanced.

Furthermore, in the above-mentioned examples, an epoxy resin is used for the protective layer 4. Alternatively, any known material requiring no high temperature heat treatment can be used. The heat treatment for forming the protective layer 4 is conducted preferably at a temperature of 300° C. or less, and more preferably at a temperature of 200° C. or less.

In the present example, in order to ensure the reliability during the soldering of the electrode portions, the Ni-plating films 6 and the solder plating films 7 are formed. Alternatively, the solder plating films 7 are directly formed without forming the Ni-plating films 6.

As is apparent from the above description, according to the present invention, by forming the resistive layer made of a Cu—Ni alloy, a high precision chip resistor having a low resistance of 1 Ω or less and a small TCR preferably within ±50 ppm/° C. can be produced. The chip resistor according to the present invention can be easily mass-produced at low cost, since production facilities such as a baking oven and a plating facility for the conventional thick film chip resistors can be directly utilized. Moreover, according to the present invention, since the end face electrodes are formed by a thin film deposition technique requiring no heat treatment at high temperature, high precision chip resistors having less drift of the resistance and less change in the TCR can be obtained. Furthermore, since the Cu—Ni alloy plating is formed, followed by heat treatment at high temperature, the Cu—Ni alloy resistive layer having a uniform composition is formed with good adhesion with the substrate, enabling the chip resistor excellent in resistance characteristic.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A chip resistor comprising:

an insulating substrate;

a plating underlying layer formed of paste on at least one face of the insulating substrate;

a resistive layer made of a Cu—Ni alloy formed from a multi-layered plating on the plating underlying layer; and end face electrodes provided on a pair of end faces of the insulating substrate facing each other so as to be connected to the resistive layer, wherein each of the end face electrodes is made of a metal thin film formed by a thin film deposition technique at a low temperature.

2. A chip resistor according to claim 1, wherein the resistive layer is made of a Cu—Ni alloy formed by heat treating a plating layer containing Cu and Ni.

3. A chip resistor according to claim 1, wherein the resistive layer is made of a Cu—Ni alloy whose weight ratio of Cu to Ni is in the range of 55:45 to 65:35.

4. A chip resistor according to claim 3, wherein the resistive layer is made of a Cu—Ni alloy whose weight ratio of Cu to Ni is in the range of 60:40.

5. A chip resistor according to claim 1, wherein the end face electrodes are made of a metal thin film formed from metal selected from the group consisting of Cr, a Cr alloy, Ti, and Ni.

6. A chip resistor according to claim 5, wherein the end face electrodes are made of a metal thin film formed from an Ni—Cr alloy.

7. A chip resistor according to claim 1, wherein the end face electrodes are provided so as to cover the pair of end faces of the insulating substrate facing each other in substantially a ]-shape.

8. A chip resistor according to claim 1, further comprising a protective layer provided at least on a portion of the resistive layer which is not covered with the end face electrodes.

9. A chip resistor according to claim 1, wherein the metal thin film is deposited by sputtering, ion plating, or plasma CVD.

10. A chip resistor comprising an insulating substrate, a plating underlying layer formed of paste on at least one face of the insulating substrate, a resistive layer made of a Cu—Ni alloy formed from a multi-layered plating on the plating underlying layer, and end face electrodes provided on a pair of end faces of the insulating substrate facing each other so as to be connected to the resistive layer, wherein each of the end face electrodes is made of a metal thin film formed by a thin film deposition technique at a low temperature, and the resistive layer is made of a Cu—Ni alloy whose weight ratio of Cu to Ni is in the range of 55:45 to 65:35.

11. A method for producing a chip resistor, comprising the steps of:

forming a plating underlying layer at least on one face of an insulating substrate;

forming a plating layer containing Cu and Ni on the plating underlying layer, wherein the plating layer containing Cu and Ni is formed by the step of forming a first plating layer selected from the group consisting of a Cu-plating layer and an Ni-plating layer, and the step of forming a second plating layer containing a Cu—Ni alloy on the first plating layer;

heat-treating the plating layer containing Cu and Ni to form a resistive layer; and depositing metal thin films on a pair of end faces of the insulating substrate facing each other so as to be connected to the resistive layer.

12. A method for producing a chip resistor according to claim 11, wherein the plating layer containing Cu and Ni is formed so that the resistive layer is made of a Cu—Ni alloy whose weight ratio of Cu to Ni is in the range of 55:45 to 65:35.

13. A method for producing a chip resistor according to claim 12, wherein the plating layer containing Cu and Ni is formed so that the resistive layer is made of a Cu—Ni alloy whose weight ratio of Cu to Ni is 60:40.

14. A method for producing a chip resistor according to claim 11, wherein the end face electrodes are made of metal selected from the group consisting of Cr, a Cr alloy, Ti, and Ni.

15. A method for producing a chip resistor according to claim 14, wherein the end face electrodes are made of a metal thin film formed from an Ni—Cr alloy.

16. A method for producing a chip resistor according to claim 11, wherein the metal thin film is deposited by sputtering, ion plating, or plasma CVD.

17. A method for producing a chip resistor according to claim 11, wherein the end face electrodes are formed so as to cover the pair of end faces of the insulating substrate facing each other in substantially a ]-shape.

18. A method for producing a chip resistor according to claim 11, further comprising the step of forming a protective layer on the resistive layer.

19. A method for producing a chip resistor, comprising the steps of:

forming a plating underlying layer at least on one face of an insulating substrate;

forming a plating layer containing Cu and Ni on the plating underlying layer, wherein the plating layer containing Cu and Ni is formed by alternately repeating Cu-plating and Ni-plating a plurality of times;

heat-treating the plating layer containing Cu and Ni to form a resistive layer; and depositing metal thin films on a pair of end faces of the insulating substrate facing each other so as to be connected to the resistive layer.

20. A method for producing a chip resistor according to claim 19, wherein the plating layer containing Cu and Ni is formed so that the resistive layer is made of a Cu—Ni alloy whose weight ratio of Cu to Ni is in the range of 55:45 to 65:35.

21. A method for producing a chip resistor according to claim 20, wherein the plating layer containing Cu and Ni is formed so that the resistive layer is made of a Cu—Ni alloy whose weight ratio of Cu to Ni is 60:40.

22. A method for producing a chip resistor according to claim 19, wherein the end face electrodes are made of metal selected from the group consisting of Cr, a Cr alloy, Ti, and Ni.

23. A method for producing a chip resistor according to claim 22, wherein the end face electrodes are made of a metal thin film formed from an Ni—Cr alloy.

24. A method for producing a chip resistor according to claim 19, wherein the metal thin film is deposited by sputtering, ion plating, or plasma CVD.

25. A method for producing a chip resistor according to claim 19, wherein the end face electrodes are formed so as to cover the pair of end faces of the insulating substrate facing each other in substantially a ]-shape.

26. A method for producing a chip resistor according to claim 19, further comprising the step of forming a protective layer on the resistive layer.

* * * * *